US009730500B1

(12) United States Patent
Provost et al.

(10) Patent No.: US 9,730,500 B1
(45) Date of Patent: Aug. 15, 2017

(54) SHAVING RAZOR STAND

(71) Applicant: SHAVELOGIC, INC., Dallas, TX (US)

(72) Inventors: Craig A. Provost, Boston, MA (US); Robert A. Wilson, Dallas, TX (US); William E. Tucker, Attleboro, MA (US); John W. Griffin, Moultonborough, NH (US)

(73) Assignee: SHAVELOGIC, INC., Dallas, TX (US)

( * ) Notice: Subject to any disclaimer, the term of this patent is extended or adjusted under 35 U.S.C. 154(b) by 106 days.

(21) Appl. No.: 14/811,539

(22) Filed: Jul. 28, 2015

Related U.S. Application Data

(60) Provisional application No. 62/032,026, filed on Aug. 1, 2014.

(51) Int. Cl.
*B26B 21/00* (2006.01)
*A45D 27/29* (2006.01)

(52) U.S. Cl.
CPC ..... *A45D 27/29* (2013.01)

(58) Field of Classification Search
CPC ..... A45D 27/29
USPC ..... D6/526; 206/208; 211/70.6; 248/127; 30/541
See application file for complete search history.

(56) References Cited

U.S. PATENT DOCUMENTS

D335,599 S * 5/1993 Novak ..... D6/526
5,228,580 A * 7/1993 Grange ..... A45D 27/29 211/70.6
D400,746 S * 11/1998 Althaus ..... D6/526
5,966,822 A * 10/1999 Coffin ..... A45D 27/29 30/298.4
6,634,492 B1 * 10/2003 Cox ..... A45D 27/29 206/208
D572,188 S * 7/2008 Prat-Pfister ..... D13/108
D576,436 S * 9/2008 Provost ..... D6/526
D621,638 S * 8/2010 Meech ..... D28/73
D622,160 S * 8/2010 Bridges ..... D9/749
D628,001 S * 11/2010 McGarry ..... D6/534
7,858,027 B2 * 12/2010 Trissel ..... A45D 27/46 137/3
D632,110 S * 2/2011 Cooper ..... D6/526
D634,955 S * 3/2011 Cavazos Jimenez ..... D6/526
D635,384 S * 4/2011 Yoon ..... D6/526
D657,740 S * 4/2012 Prat-Pfister ..... D13/108
D667,664 S * 9/2012 McCoy ..... D6/524
D677,503 S * 3/2013 Floyd ..... D6/526
D698,185 S * 1/2014 Cosper ..... D6/526
D699,473 S * 2/2014 Szczepanowski ..... D6/526
D720,154 S * 12/2014 Provost ..... D6/526
D728,963 S * 5/2015 Provost ..... D6/526
D761,586 S * 7/2016 Kulshreshtha ..... D6/526
2004/0060829 A1 * 4/2004 Oldenkamp ..... A47K 5/04 206/77.1
2016/0000203 A1 * 1/2016 Williams ..... A45D 27/46 206/208

* cited by examiner

*Primary Examiner* — Bradley Duckworth
(74) *Attorney, Agent, or Firm* — Leber IP Law

(57) ABSTRACT

Stands for safety shaving razors are disclosed. The stands include a pair of generally vertical members, connected by a generally U-shaped horizontal member configured to receive a portion of a razor handle, and a base configured with a cavity dimensioned to receive a portion of the razor handle.

7 Claims, 8 Drawing Sheets

SHAVING RAZOR STAND

RELATED APPLICATIONS

This application claims priority to U.S. Provisional Patent Application No. 62/032,026, filed Aug. 1, 2014, the disclosure of which is hereby incorporated by reference in its entirety.

BACKGROUND

This invention relates generally to shaving and, more particularly, to a shaving razor stand for holding a safety shaving razor in a particular orientation when not in use.

SUMMARY

Generally, this invention relates to a stand for holding a safety shaving razor in an upright orientation when not in use.

In one aspect the invention features a shaving razor stand comprising a pair of generally vertical members, connected by a generally U-shaped horizontal member configured to receive a portion of a razor handle, and a base configured with a cavity dimensioned to receive a portion of the razor handle.

Some implementations include one or more of the following features.

The cavity of the razor stand may be configured with a port that opens on the front side of the stand. A portion of the base may be constructed from elastomeric material. The horizontal member may be configured with razor support elements. The cavity may include a region of elastomeric material. The elastomeric material may be configured to interact with a portion of a handle of a safety shaving razor. The horizontal element may be configured to position the razor in a predetermined orientation.

In some implementations, the base may include a platform element on which the portion of the razor handle rests, and the elastomeric material extends from the base through an opening in the platform element.

The invention may feature a stand that may be configured to have a low center of gravity. The cavity may be configured so that the center of gravity of a shaving razor positioned in the stand will be positioned substantially within the footprint of the base. The cavity may be configured so that the center of gravity of a shaving razor positioned in the stand will be positioned substantially directly over the center of the base.

DETAILED DESCRIPTION

Figure 1:
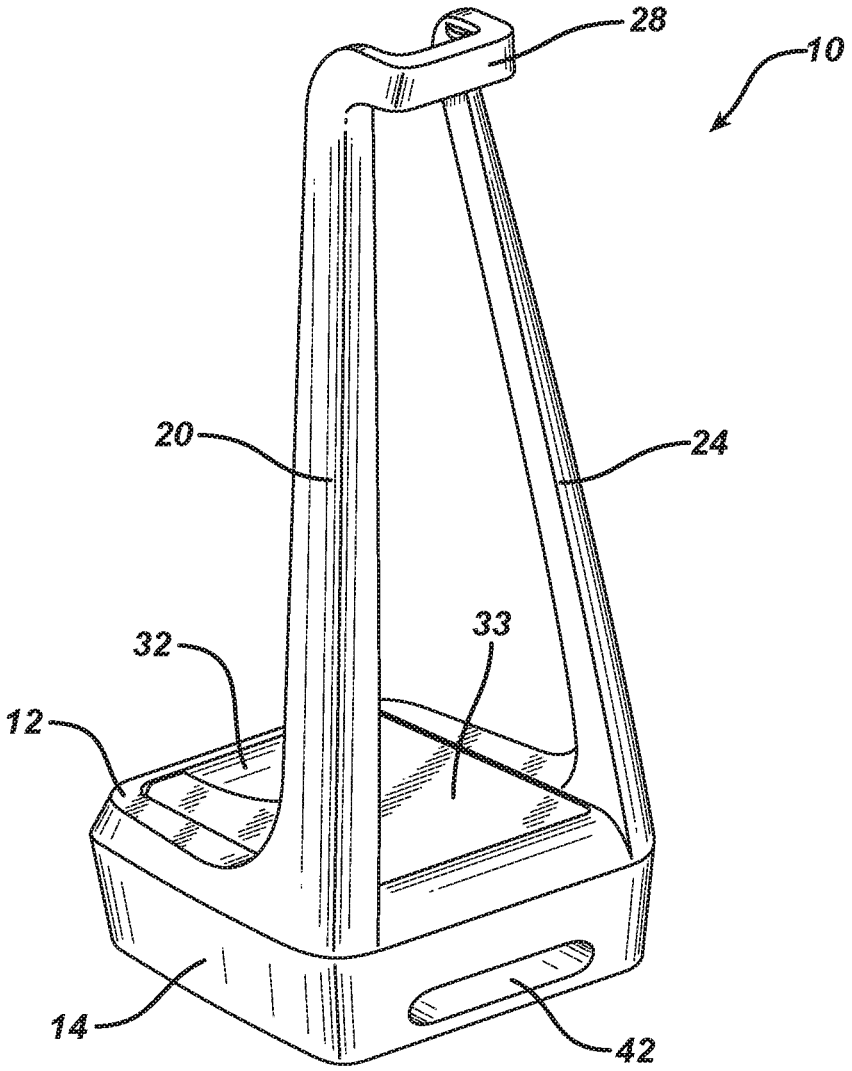
FIG. 1 is a perspective view of shaving razor stand according to one embodiment of the present invention.
Figure 2:
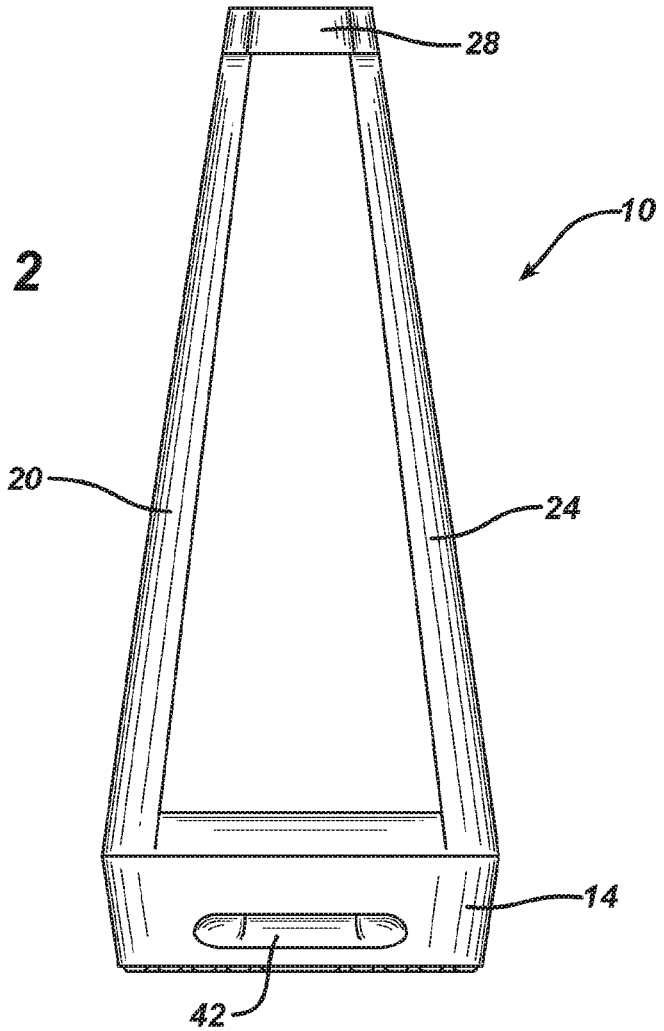
FIG. 2 is a front elevational view of the stand.

The present disclosure relates generally to shaving and, more particularly, to a shaving razor stand for holding a shaving razor in a particular orientation when not in use. The stand allows the razor to be stored upright, allowing water to drain from the cartridge during storage.

Referring to FIGS. 1-3 and 7, a razor stand 10 is configured to hold a safety shaving razor 40 (FIG. 7) in a desired orientation. The stand 10 is composed of vertical members 20, 24 that extend from connecting member 12. Preferably vertical members 20, 24 are integrally molded with connecting member 12. Connecting member 12 is generally U-shaped and defines the general shape of the footprint of the stand. Cradle member 28 connects the upper portions of the vertical members 20, 24 and is configured to receive a portion of a shaving razor 40. Cradle member 28 is disposed generally perpendicular to the long axis of vertical members 20, 24, and extends forward of the vertical members along the horizontal plane so as to surround and support the razor handle. In preferred implementations, the cradle member is formed integrally with the vertical members.

Figure 3:
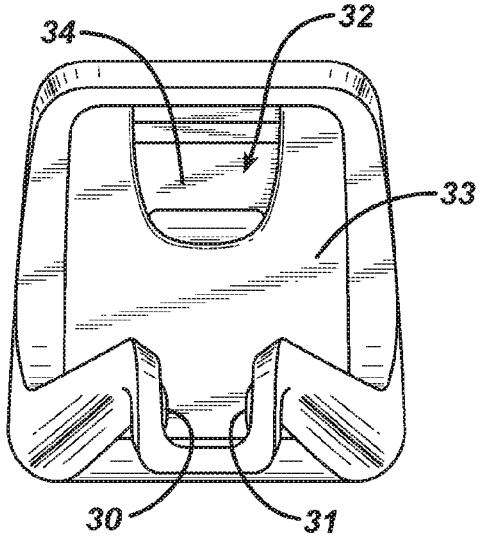
FIG. 3 is a top plan view of the stand.
Figure 5:
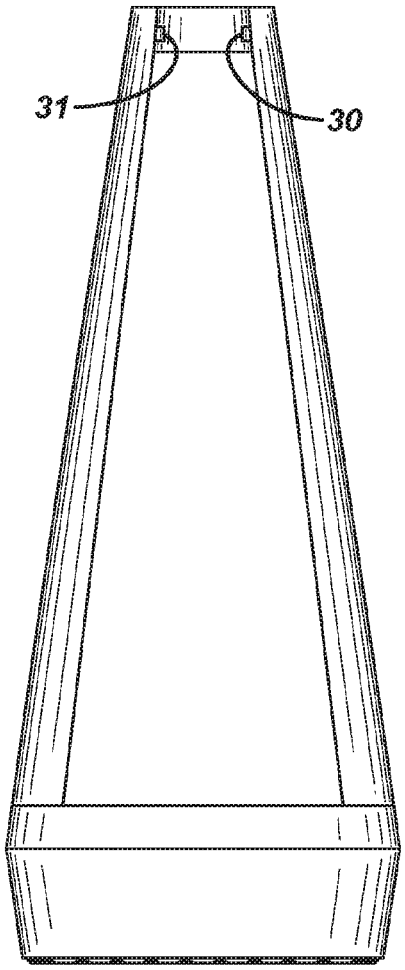
FIG. 5 is a rear elevational view of the stand.
Figure 9:
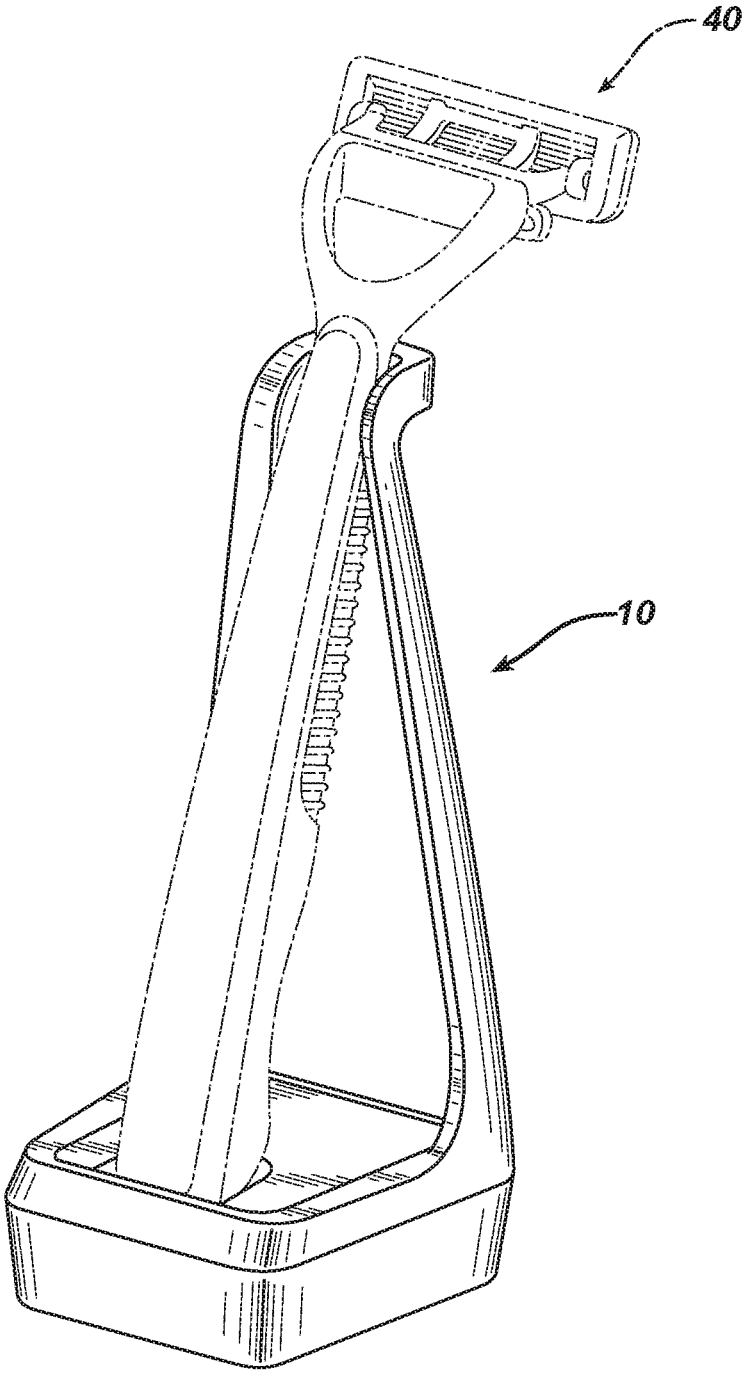
FIG. 9 is a rear perspective view of the stand with a shaving razor shown in phantom.

Referring to FIGS. 3, 5 and 9, support members 30, 31 are disposed inside cradle member 28 on opposing sides. Support members 30, 31 help guide the safety shaving razor into a predetermined orientation with respect to stand 10. The support members are formed during the molding/shaping process. While shown in elliptical form, it should be understood that the support elements could take any desired shape so long as they successfully guide insertion of the shaving razor into the stand and support it when stored in the stand. In some implementations, the support elements may be omitted and the cradle member shaped to provide the same functionality.

Figure 7:
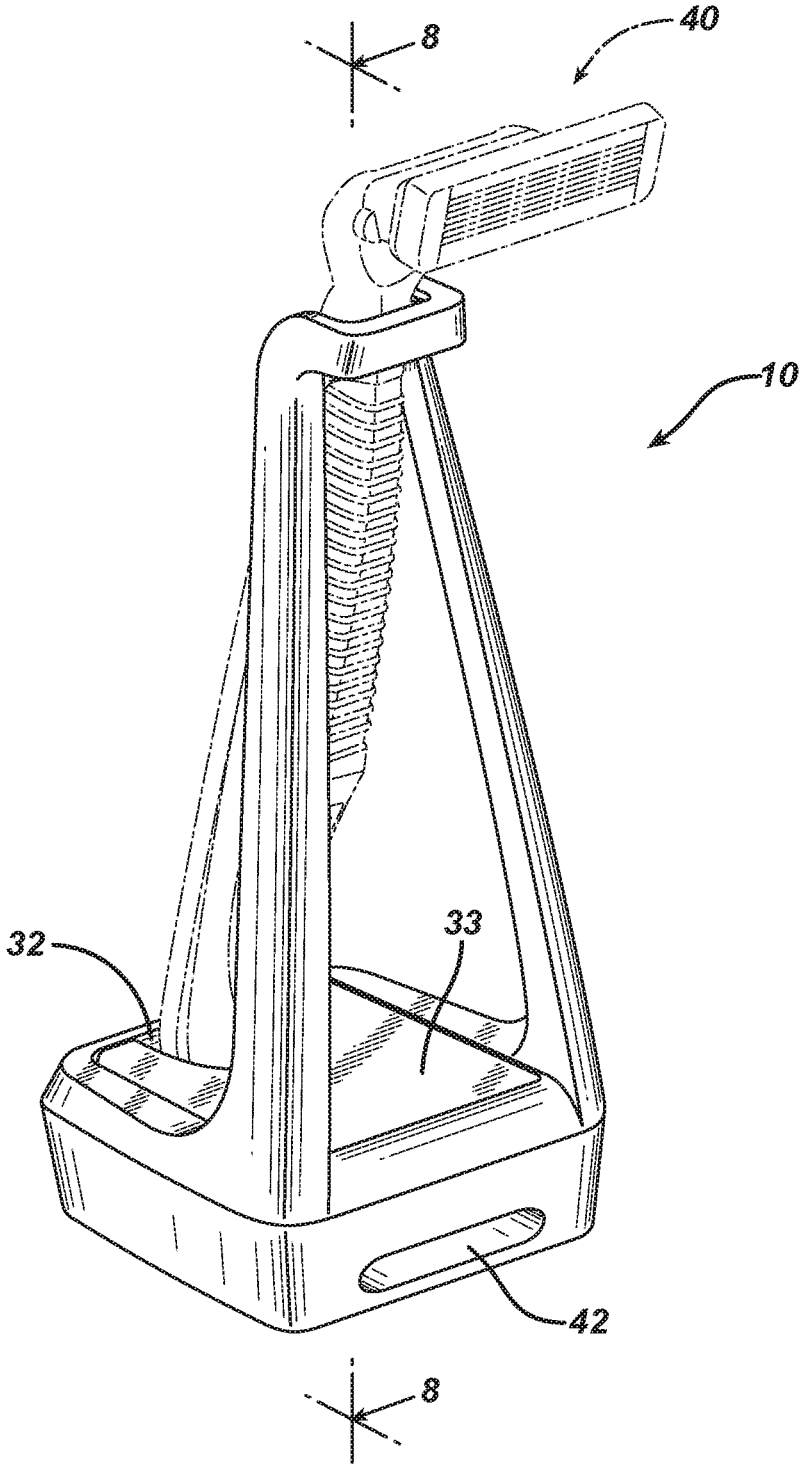
FIG. 7 is a top, right perspective view of the stand with a shaving razor shown in phantom.
Figure 8:
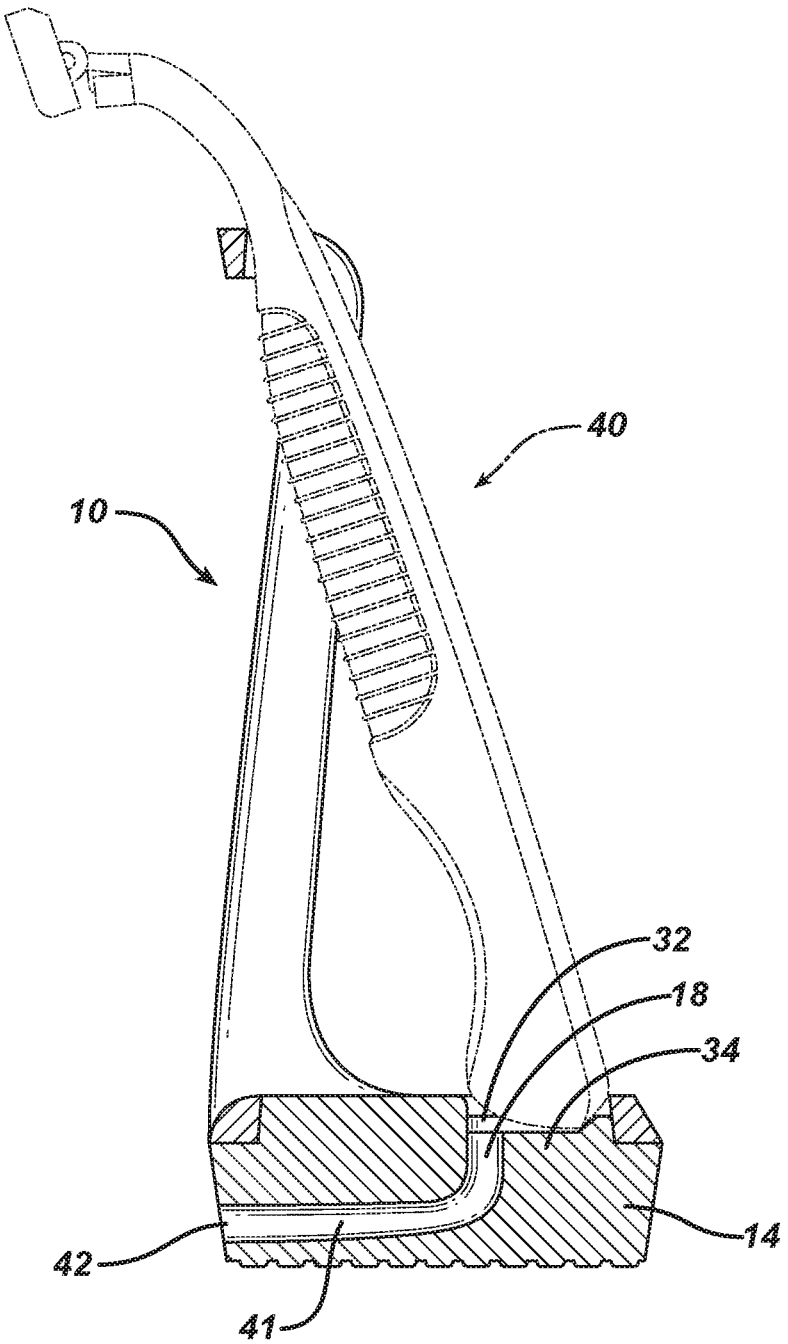
FIG. 8 is a section view of the stand taken along sectional indicator 8 shown in FIG. 7, the shaving razor shown in phantom.

Referring to FIGS. 3, 7 and 9, a platform element 33 is disposed in connecting member 12. A portion of the rear edge of element 33 defines cavity 32. Cavity 32 is configured to receive a portion of the shaving razor 40, e.g., an end of the razor handle. Port 18 is disposed within cavity 32 generally near the front edge, as shown in FIG. 8. The cavity 32 of the stand 10 and the portion of the handle to be received are preferably formed to interact in a complementary manner.

Base element 14 is configured to substantially cover the lower surface of connecting element 12 and platform element 33. Advantageously, base element 14 occupies a small area such that the stand takes up minimal space on a counter or other surface. The small footprint of the base has similar dimensions (width and length) as the long edge of the shaving cartridge (FIG. 7). Preferably, the area of the base is 18.50 square centimeters but could range from generally 18.00 to 19.00 square centimeters.

Referring to FIGS. 3 and 8, a portion 34 of the base element 14 is exposed in the cavity 32. Portion 34 provides a soft landing zone for the handle of the razor when placing the shaving razor in the stand. As shown in FIG. 3, portion 34 may be generally oblong or rectangular in shape.

Figure 4:
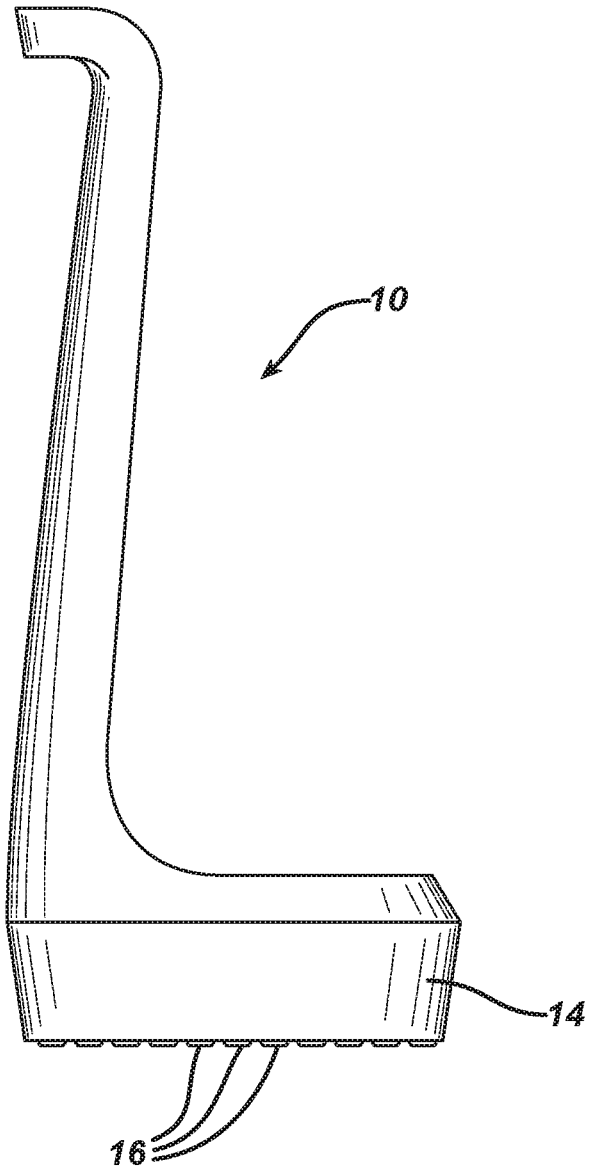
FIG. 4 is a right side elevational view of the stand.
Figure 6:
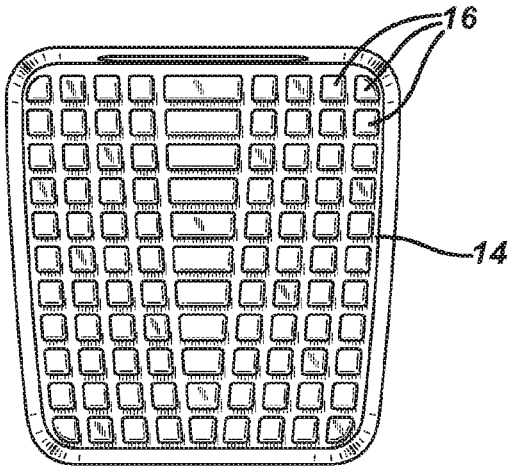
FIG. 6 is a bottom plan view of the stand.

Referring to FIGS. 4 and 6, base element 14 has a plurality of gripping elements 16 that ensure the stand 10 does not unduly slide or slip when in contact with a smooth surface, e.g. a generally flat portion of a sink or shelf. Preferably, gripping elements 16 are made of an elastomeric material with a Shore A durometer of 20 to 80, e.g. from 40 to 60. In some cases the entire base is made of elastomeric material. Another embodiment of the stand may feature a base that is coated with a soft touch material, e.g. an elastomeric material that applied via an aerosolized spray, which would provide similar anti-slip characteristics.

Referring to FIGS. 3 and 8, as noted above the port 18 is configured within the base element 14 and is designed to collect and transport excess water away from the shaving razor 40 and out of the stand 10. Preferably port 18 drains out the front of the stand through a conduit 41 (FIG. 8) that terminates in an opening 42, as shown, providing a relatively short path for the water and allowing the user to easily visualize water draining from the stand and wipe it up if desired.

Referring to FIGS. 1, 6, and 8, base element 14 is configured to be press fit into the body 12. In alternate embodiments, the base element may be integrally molded with the body, mechanically attached, e.g. ultrasonically welded or similar, or chemically attached, e.g. glued with adhesive.

The stand is advantageously designed with a low center of gravity, such that it provides a stable platform to support the safety razor, and so that the stand itself does not tip over if it is bumped when empty. For example, in some implementations the center of gravity of the stand is less than an inch above the surface on which the stand is placed.

Figure 10A:
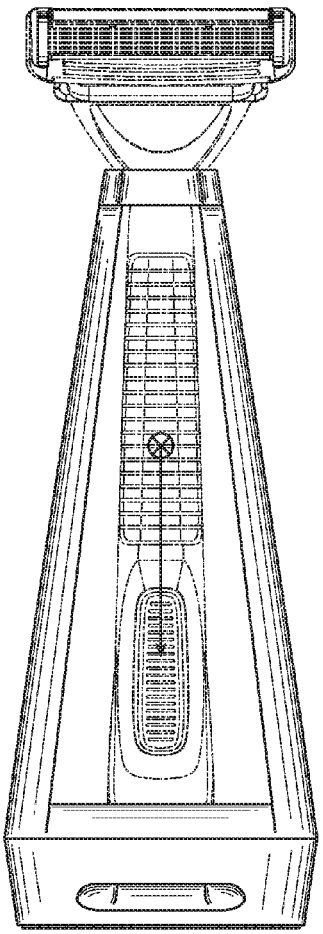
FIG. 10A is a front elevational view of the stand with a shaving razor shown in phantom.
Figure 10B:
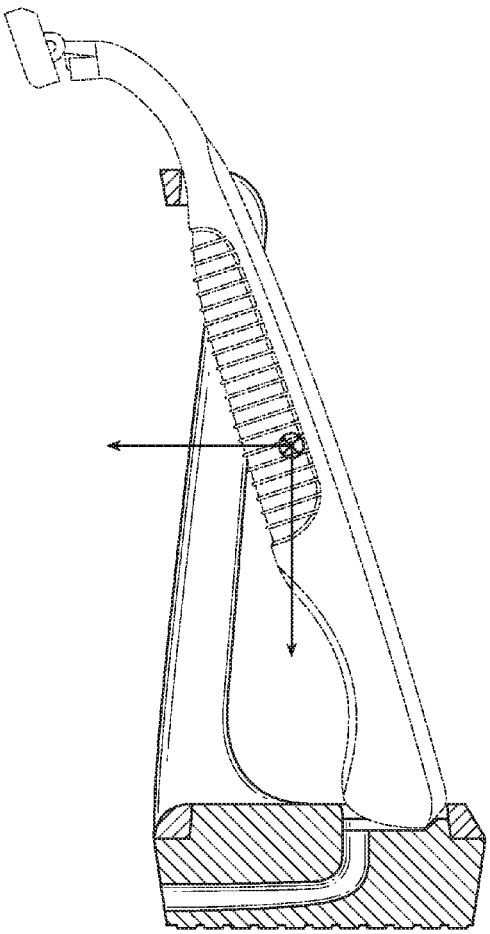
FIG. 10B is a sectional view of FIG. 10A.

Moreover, the stand is designed so that the center of mass of the razor will be positioned within the footprint and preferably substantially directly over the center of the base element 16, for example, within 0.5 inch of the center, as shown in FIGS. 10A and 10B. Positioning the razor in this manner lends further stability to the stand when in use. This is accomplished by appropriately orienting the safety razor with respect to the stand in concert with the dimensions of the base.

The stand 10 can be made of any suitable material including, for example, polyethylene terephthalate (PET or PETE), high density (HD) PETE, thermoplastic polymer, polypropylene, oriented polypropylene, polyurethane, polystyrene, acrylonitrile butadiene styrene (ABS), polyvinyl chloride (PVC), polytetrafluoroethylene (PTFE), polyester, metal, synthetic rubber, natural rubber, silicone, nylon, polymer, wood, antibacterial or antimicrobial materials, insulating, thermal, other suitable sustainable or biodegradable materials, or any combination thereof. Furthermore, it should be understood that the body could be constructed of material that could be colored or plated to look like metal, wood, or other materials.

Other Embodiments

A number of embodiments have been described. Nevertheless, it will be understood that various modifications may be made without departing from the spirit and scope of the disclosure.

For example, a ferrous magnet or a plurality of ferrous magnets can be implanted in the stand to provide enhanced engagement between the handle of the shaving assembly and the stand. Corresponding metal strips could be affixed, implanted or co-molded to the handle to ensure proper interaction with the magnets when the handle is in the base. The magnetic interaction would provide a retention force so that the shaving assembly would be securely held in the stand, but the retention force would not be so strong as to unduly complicate the removal of the shaving assembly from the stand when desired, e.g. as when initiating shaving.

Accordingly, other embodiments are within the scope of the following claims.

What is claimed is:

1. A shaving razor stand comprising:

a pair of generally vertical members, having upper ends connected by a generally U-shaped horizontal cradle member and lower ends connected by a generally U-shaped horizontal connecting member, a generally planar platform disposed within the connecting member, and an elastomeric base element supporting the platform and connecting member; wherein the base and platform define a cavity that is recessed relative to the plane of the platform, with a portion of the base extending through an opening in the platform to define a portion of a floor of the cavity.

2. The razor stand of claim 1, where the cavity includes a port in fluid communication with an opening on the front side of the stand.

3. The razor stand of claim 1, wherein the horizontal cradle member is configured with razor support elements that extend inwardly from the cradle member to face each other in opposing spaced relation.

4. The razor stand of claim 3, wherein the horizontal cradle element is configured to position the razor in a predetermined orientation and the support elements guide the razor into the predetermined orientation.

5. The razor stand of claim 1, wherein the stand is configured to have a low center of gravity.

6. The razor stand of claim 5, wherein the center of gravity of the stand is less than an inch above a lower surface of the base element.

7. The razor stand of claim 1 wherein the base element has a lower surface having an area of from 18 to 19 $cm^2$.

* * * * *